US007621040B2

(12) United States Patent
Sullivan

(10) Patent No.: US 7,621,040 B2
(45) Date of Patent: Nov. 24, 2009

(54) OPTICAL SELECTABLE FORCE IMPACT TOOL

(76) Inventor: Robert W. Sullivan, 3310 Los Nogales Rd., Simi Valley, CA (US) 93063

( * ) Notice: Subject to any disclaimer, the term of this patent is extended or adjusted under 35 U.S.C. 154(b) by 778 days.

(21) Appl. No.: 11/175,466

(22) Filed: Jul. 5, 2005

(65) Prior Publication Data

US 2007/0015394 A1 Jan. 18, 2007

(51) Int. Cl.
*H01R 43/00* (2006.01)

(52) U.S. Cl. ..... 29/750; 29/751; 29/749; 29/564.4; 7/107

(58) Field of Classification Search ..... 29/566.4, 29/750, 751, 854, 720, 749; 439/395; 7/107, 7/158; 81/463
See application file for complete search history.

(56) References Cited

U.S. PATENT DOCUMENTS

| | | | | |
|---|---|---|---|---|
| 3,708,852 | A * | 1/1973 | Mason | 29/749 |
| 3,997,956 | A * | 12/1976 | McKee | 29/564.1 |
| 6,689,093 | B2 * | 2/2004 | Landau | 604/69 |
| 6,783,509 | B1 * | 8/2004 | Landau et al. | 604/70 |
| 7,266,878 | B1 * | 9/2007 | Sullivan | 29/566.4 |

* cited by examiner

*Primary Examiner*—Minh Trinh
(74) *Attorney, Agent, or Firm*—Gene W. Arant

(57) ABSTRACT

An user-friendly impact tool for wire end termination in which the pre-set compression of a main drive spring is adjusted by hand with an adjustment screw having a knurled knob that is both visible and hand-accessible through an opening in the housing wall, and also having a vernier scale formed partly on the outer housing wall surface and partly on the knurled knob itself to correctly indicate the pre-load adjustment position of the drive spring.

2 Claims, 3 Drawing Sheets

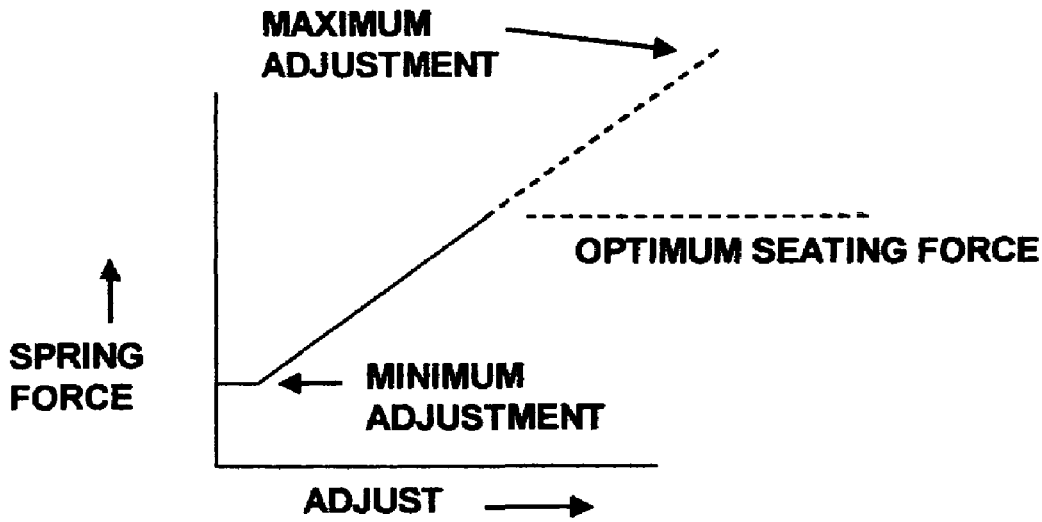
FIG. 3(a)
SCREW ADJUSTMENT SYSTEM
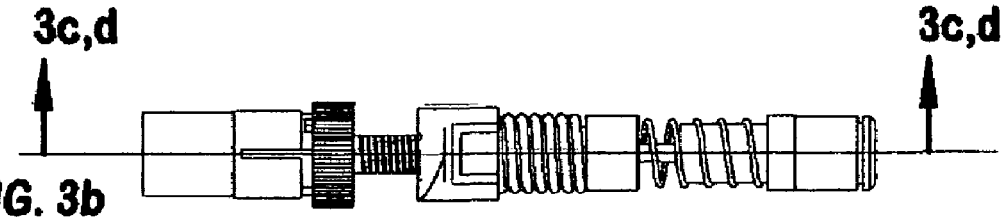
FIG. 3b
FIG. 3c
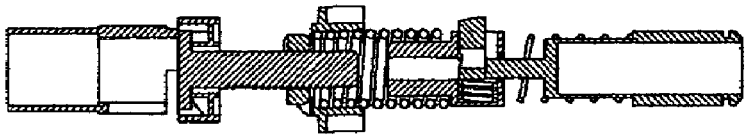
FULL ADJUSTMENT
FIG. 3d
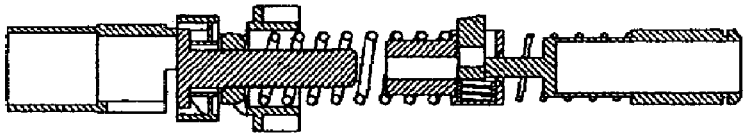
MINIMUM ADJUSTMENT

OPTICAL SELECTABLE FORCE IMPACT TOOL

CROSS-REFERENCE TO RELATED APPLICATION

This application claims the priority of my prior copending application Ser. No. 11/129,257 filed May 13, 2005 which is entitled STEADY-FORCE METHOD AND APPARATUS FOR WIRE END TERMINATION AND CUTTING.

FIELD OF THE INVENTION

This invention relates to making electrical wiring connections in telecommunication connector blocks or terminals.

DESCRIPTION OF RELATED PRIOR ART

U.S. Pat. No. 3,708,852 issued in 1973 to Mason shows a hand-operated impact tool for creating an impact from a hammer onto a wire termination tool for shock loading the tool blade onto a wire that is to be inserted into a connector. The impact was created by compressing a hammer spring 80—otherwise known as a main drive spring—and then suddenly releasing the main drive spring by a mechanical trigger so that its accumulated compression would drive the hammer 76 downward. Thus the main spring that was manually compressed to a predetermined level could be abruptly released, and its resulting momentum would drive the termination tool member forward to seat the conductor wire in the connector. An end of the wire protruding from the connector might be cut off at the same time.

The Mason patent provided adjustable pre-loading of the main drive spring, by means of an adjustment screw 88 which could either raise or lower the position of a drive spring seat 82 that abutted the rearward or upper end of the main drive spring 80. The drive spring seat was longitudinally slidable inside the tool housing but apparently would not rotate in response to adjustment of the screw. Thus by means of screwdriver rotation of adjustment screw 88 a desired level of pre-loading could be achieved. Since the length of the hand stroke of the tool was limited by the dimensions of its housing, an adjustment of the spring pre-load would correspondingly adjust the magnitude of impact delivered to the wire termination tool and wire.

Before 1973, according to Mason, tradesmen were using hand force alone to insert the conductor wire into the connector. The impact tool then appeared to be a step forward.

Gregson U.S. Pat. No. 4,241,496 issued in 1980 showed a modification of the Mason apparatus. Rotation of its knurled knob 29 could set the impact to either a predetermined high level or a predetermined low level. A cam adjustable to either one of two positions would select either the short or longer compressed lengths for the drive spring and thereby a high or low impact force, respectively.

BACKGROUND OF THE INVENTION

Conductor wire and circuit board. Since before 1980 technicians installing telephone and data circuits have terminated the ends of insulated wires in circuit boards having connectors of the insulation displacement type. Connectors of that type have electrical contact members which form a pair of blade-like cutting edges occupying a common plane with a V-shaped space between them. When the end of an insulated conductor wire is pushed down between the blade-like members, their sharp cutting edges cut through the insulation and sufficiently into the metal that the circuit board contact is then in electrically conductive engagement with the conductor wire. At the same time, some insulation surrounding the contact area is purposely left in place to protect the contacts against moisture and corrosion.

Wire Termination Tool. It has been standard practice to use a wire termination tool with a metal tool body that also carries a blade, for inserting the wire end between the connector contacts; or alternatively, for inserting the wire end between the connector contacts while concurrently cutting off a protruding end of the conductor wire. One standard type of such a wire termination tool is known as a "110 Blade", and another standard type is known as a "66 Blade". While those two types of tools are somewhat differently shaped to work with differently shaped connector panels, their function is essentially the same. A conductor wire to be attached to the connection panel is placed across the front of the termination tool. The wire termination tool is then driven forward to insert the conductor wire between corresponding insulation displacement knife blade contacts and to seat the wire; or to seat the wire and concurrently cut off a protruding end of the wire.

Impact Driver or Punch-Down Tool. A hand-operated impact driver of the type shown in the Gregson patent has now become the industry standard for driving either a 110 Blade or a 66 Blade. The hand-operated driver or impact tool has a housing for slidably receiving the termination tool. The termination tool, whether a 110 Blade, 66 Blade, or other industry standard type blade, is slidably mounted within or upon the driver. The punch-down or impact driver tool contains an internal drive spring which becomes compressed when the tradesman or technician applies hand force. A factory setting on the impact tool allows either of two positions of an adjustable cam to select either a short or a longer compressed lengths for the drive spring and thereby a high or low impact force, respectively.

Compression Spring Drive Action. A forward end of the conductor wire to be inserted into the connector panel is placed across the forward end of the wire termination tool. The force of the compression spring bears against the termination tool. The technician or tradesman pushes the impact tool forward, and when the pre-set force level is reached a mechanical trigger associated with the spring then automatically releases the drive spring compression. The stored energy of the compression spring then drives the 110 or 66 Blade or other standard tool forward to insert the conductor wire into the connector of the circuit panel. At this time the technician or tradesman would be holding the impact tool steady, so as to achieve the exact impact for which the pre-set spring compression was selected. Typically, although not necessarily, the forward movement of the termination tool also concurrently cuts off a protruding end of the wire, by means of a cutting blade carried on the tool.

Abrupt release. Thus according to standard practice a spring that is pre-compressed, and then by manual force further compressed to a predetermined level, is abruptly released by a mechanical trigger to drive the termination tool. The release of the spring force and its resulting momentum, and additional force applied manually by the operator, will then drive the termination tool member forward to seat the conductor wire within the connector and also to cut off its protruding end.

"Sweet Spot" for Optimum Contact. In the typical connectors of the insulation displacement type the pair of knife blades that achieve the electrical contact with a conductor wire inserted between them have defined characteristics. The blades are not entirely stiff and immobile, but are so constructed as to have a desired amount of spring action. In some installations the conductor wire is electrically connected to the panel but does not need to be cut off, and remains an active electrical conductor in both directions from the connector panel. The configuration of the knife blades provides an optimum location where it is preferred to have the conductor lodge. This may be referred to as the "sweet spot". If a conductor wire is not inserted far enough to reach the "sweet spot" the electrical contact may be inferior. And if the conductor wire is pushed in too far, there may be significant damage to the connector or to the panel on which it is mounted. Desired product design is such that if a conductor is correctly inserted at the "sweet spot" it should be possible to remove that conductor and insert a different one, for dozens or perhaps hundreds of times, without damage to the connector panel.

Connector Materials. An insulated conductor wire is usually composed of two materials; an outer polymer insulator and an inner diameter of copper, both of which are relatively soft and rather easy to cut. The connector block and its associated circuitry usually contain copper, thin plastic, and fiberglass materials that would be easily damaged, thus establishing a need for great precision in inserting a conductor wire into the connector.

Meeting Diverse Standards. The present invention is directed to obtaining precise results in inserting conductor wires into a circuit panel of the insulation displacement type. During recent years, due largely to the deregulation of the industry, many manufacturers have made all of the relevant products—the connector circuit panels, the insulated conductors attached to the panels, and the tools for accomplishing the attachment—to differing and non-uniform technical standards. Due to those differences in standards for the products of different companies the previously accepted industry-wide standards for wire insertion are no longer reliable. The force level required for cutting off the end of a conductor wire may be somewhat greater or somewhat less than the force level required to insert that wire between a pair of contact knives. If too low a spring compression level is used, the conductor wire may not become conductively seated to the full extent that is desired. If too high a compression level is used, there is a danger that the delicate mechanism of the connection panel circuit board may be damaged. Neither is desirable. For a particular connector and particular wire type the optimum force level that would be needed to seat the conductor wire properly within the contacts of the connector panel can be determined with reasonable accuracy. For a particular connector and particular wire type the force level that would be required to cut off the protruding wire end can also be determined with reasonable accuracy.

SUMMARY OF THE PRESENT INVENTION

According to the present invention an impact tool for wire end termination is provided which is user-friendly, is quickly and easily adjustable to meet the optimal impact force level needed when moving from one job to another, and will achieve precisely correct insertion of the conductor wire without damage to either the wire or the connector panel. The pre-set compression of the main drive spring is adjusted by hand with an adjustment screw that is readily accessible and visible, and can be correctly set without the need for a separate screwdriver or other tool.

DRAWING SUMMARY

Figures 1, 4, 5:
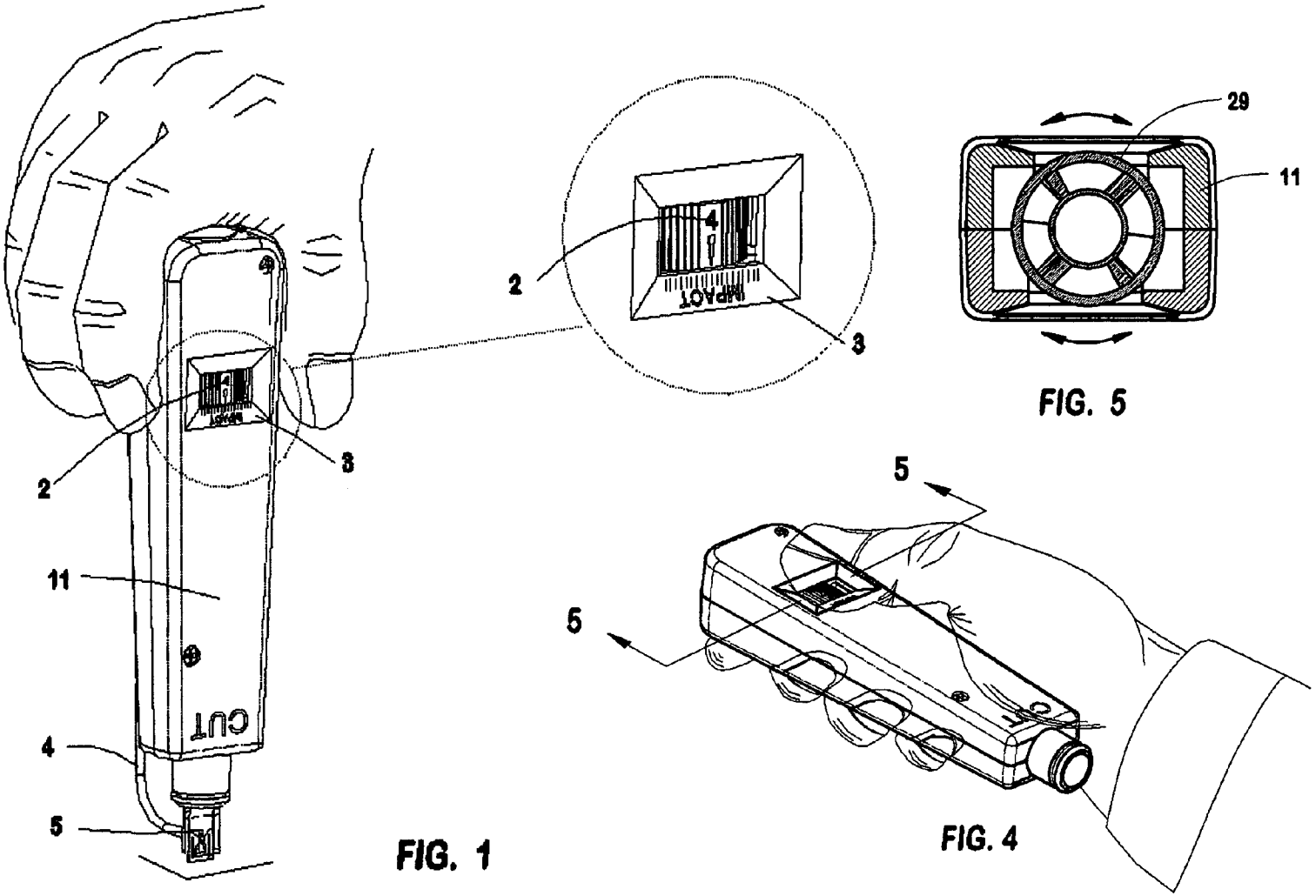
FIG. 1 is a perspective view of my new tool as it may be grasped by hand to deliver an impact to a conductor wire, and with an enlarged view of the exposed adjustment knob.

FIGS. 3*a-d* show how the adjustment screw can correctly set the pre-selected compression of the drive spring at any place between minimum and full compression to achieve the optimum wire seating;

FIG. 4 is a perspective view illustrating how the adjustment screw is adjusted by hand; and FIG. 5 is a cross-sectional view of the housing and knurled adjustment knob taken on line 5-5 of FIG. 4.

DETAILED DESCRIPTION OF THE INVENTION

FIGS. 1-5

As shown in FIG. 1 of the drawings, the hand-held tool assembly has an elongated hollow housing 11 the upper end of which is shaped to be grasped by hand. A wire end termination tool 5 attached to lower end of the assembly receives a conductor wire 4 that is to be inserted into an insulation-displacement connector.

Figure 2:
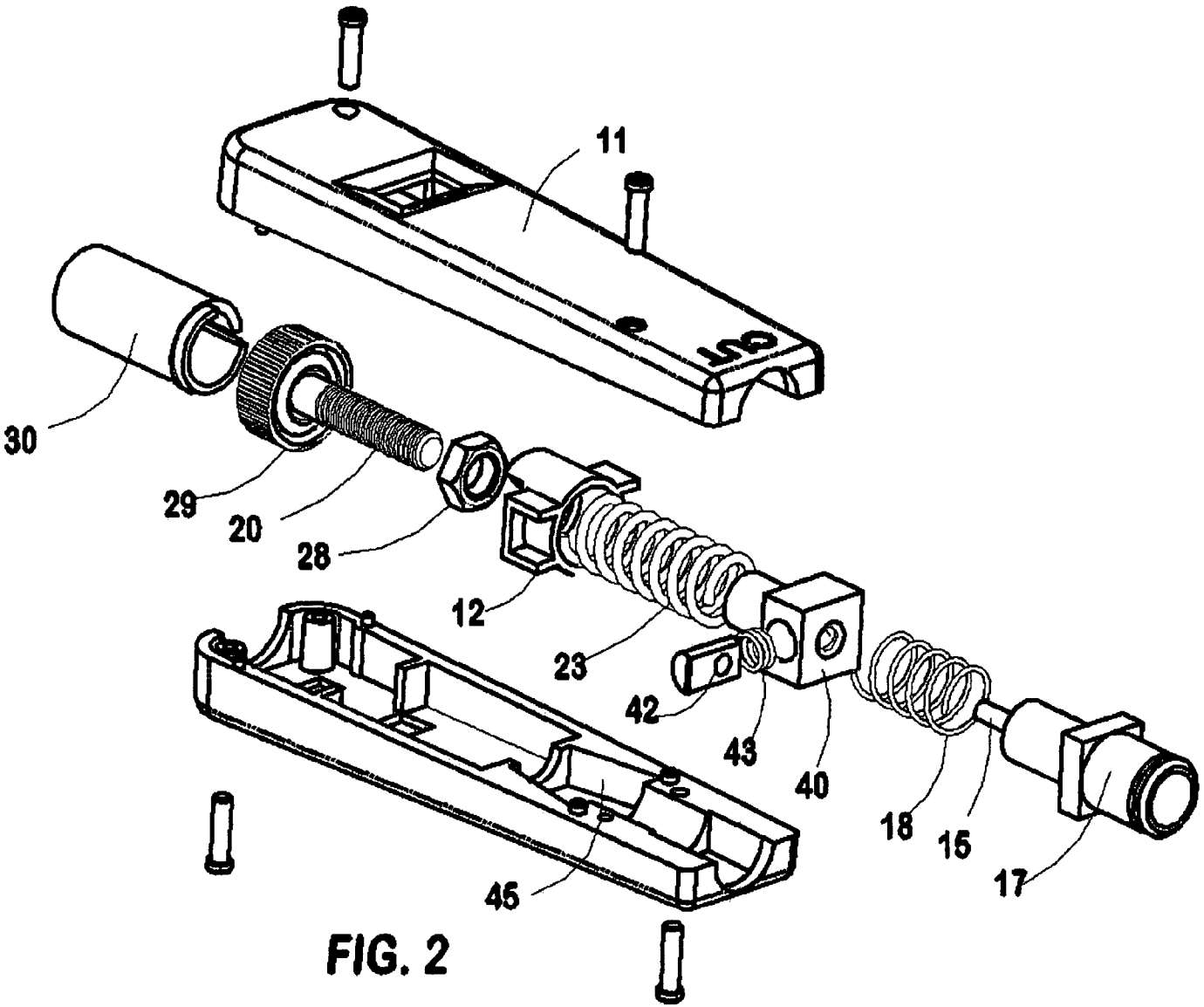
FIG. 2 is an exploded perspective view of the interior parts of the tool.

Reference is now made particularly to FIG. 2. The housing 11 is made of two plastic parts which fit together to contain all parts of the mechanism. An adjustment screw 20 has a knurled knob 29 on its upper end. The screw 20 is held in a centered rotatable position by the adjustment screw support member 30, and adapter 12, held fast by the housing. The threaded shank of screw 20 engages a nut 28, which acts as a drive spring seat, held in a non-rotatable relation to the housing by the drive spring adapter 12. Adapter 12 is itself non-rotatable in the housing and has in its upper end a hexagonal opening, not specifically shown in the drawing, which receives the nut 28.

The main drive spring 23 is an elongated compression spring which has its upper end received by the adapter 12. On its lower end drive spring 23 is received upon a short tubular extension of hammer block 40.

In the rearward or lower part of housing 11 a pair of cam surfaces 45 as shown in FIG. 2 define a chamber defined to receive the hammer block 40. During operation of the tool the hammer block reciprocates a relatively short distance within that chamber, in a direction longitudinal of the housing. One of the cam surfaces 45 cooperates with sear pin 42 to achieve mechanical triggering of the impact.

A slide 17 is disposed within the lower end portion of the housing and longitudinally slidable therein. Wire insert tool 5, shown in FIG. 1, is attached to the slide in a manner well known in the art. Another compression spring 18, located between the hammer block 40 and the slide 17, acts to return the slide to its starting position after an impact blow has been delivered.

When the operator pushes the tool down to insert conductor 4 into a connector the slide 17 moves upward within the housing. Pin 15 on the slide transmits pressure through hammer block 40 into the drive spring 23. Drive spring 23 then becomes further compressed in response to the downward force applied by the operator. At the same time, sear pin 42 is a triggering member which moves longitudinally of the housing along the associated cam surface 45. When a certain lateral displacement has occurred, pin 15 enters the hole in hammer block 40, providing a mechanical triggering of the impact force from spring 23.

After the impact blow has driven the conductor into its connector the operator releases the housing, and both of the springs 23 and 18 expand toward their starting positions. A sear spring 43 causes the sear pin 42 to return to its starting place.

Adjustment of the pre-set compression of drive spring 23 is accomplished by hand only, using the knurled knob 29. See FIGS. 4 and 5 in particular. See also FIG. 1. The Vernier scale 2 on the knob, and associated index markings 3 on the housing, allow the operator to instantly judge the position of pre-set spring compression.

FIG. 3(*a*) illustrates the operation of the screw adjustment system. Spring force can be set anywhere between minimum and maximum settings. FIG. 3*b* shows the position of the apparatus after pin 15 has entered the hole in hammer 40 as triggering is about to occur. FIG. 3*c* shows maximum pre-set spring compression while FIG. 3*d* shows minimum pre-set compression.

Although the presently preferred forms of my invention have been disclosed herein, it will be understood that other modifications should be apparent to those skilled in the art, and that the scope of my invention is to be judged only by the appended claims.

What I claim is:

1. A hand-held impact tool assembly for wire end termination which will achieve precisely correct insertion of a conductor wire into an associated connector panel without damage to either the wire or the connector panel, comprising, in combination:

an elongated hollow housing the upper end of which is shaped to be grasped by hand;

an adjustment screw longitudinally disposed within the housing, having on its upper end a knurled rotatable knob for drivingly rotating the screw and which is exposed to view through a lateral opening at the upper end of the housing;

the housing having indexed markings on its outer surface, and the knurled knob having a vernier scale which in cooperation with the housing markings allows the operator to judge the incremental rotational position of the adjustment screw for optimal impact force setting;

an adapter below the adjustment screw and nonrotatably supported within the housing in a longitudinally slidable relation;

a nut non-rotatably received in an upper end of the adapter, the lower end of the adjustment screw being received by the nut which, together with the housing, holds the adjustment screw rotatably supported in a centered position within the housing;

an elongated main drive compression spring having its upper end rigidly supported in non-rotatable relation within the adapter and engaged by the nut, which thereby acts as a drive spring seat;

a hammer block non-rotatably supported within the housing in non-rotatable relation therewith and below the drive spring, the lower end of the drive spring engaging the hammer block;

the housing, adjustment screw, adapter, and drive spring cooperating to apply an incrementally preadjusted level of force to the upper surface of the hammer block as a function of a manually selected rotational position of the knurled knob;

a chamber within which the hammer block is non-rotatably supported, the chamber having a longitudinally tapered cam surface formed in one wall of the housing, the inmost end of that cam surface being at it upper end;

the hammer block which normally rests in the bottom of the chamber being reciprocably slidable a relatively short distance upward within that chamber whenever an impact is to be generated, the hammer block also having both a longitudinal opening and a lateral opening;

a sear pin cooperating with the cam surface in the chamber so as to selectively enter the lateral opening in the hammer block when the hammer block is pushed upward in the chamber, the sear pin also having a hole therethrough at a midpoint of its length;

a slide for driving a wire insert tool that may be attached thereto, the slide being disposed within the lower end portion of the housing and longitudinally upwardly slidable therein, and having a pin projecting from its upper end; and a slide return spring cooperating with the upper end of the slide;

the operation being such that when the operator pushes the housing down to insert a conductor wire into a connector, the reverse pressure from the connector and conductor wire then causes the slide to move upward within the housing, the hole in the sear pin then becomes radially and vertically aligned with the pin on the upper end of the slide, the pin on the upper end of the slide then enters the longitudinal opening in the hammer block allowing the hammer block to be lifted by force of the return spring, and pressure previously loaded onto the drive spring then overcomes the pressure of the return spring and causes downward movement of the hammer block to impart the desired impact to the conductor wire that is to be inserted.

2. A hand-held impact tool assembly for wire end termination which will achieve precisely correct insertion of a conductor wire into an associated connector panel without damage to either the wire or the connector panel, comprising:

an elongated hollow housing the upper end of which is shaped to be grasped by hand;

an adjustment screw longitudinally disposed within the housing, the adjustment screw having on its upper end a knurled rotatable knob for drivingly rotating the screw and which is exposed to view through a lateral opening at the upper end of the housing;

the housing having indexed markings on its outer surface, and the knob having an associated vernier scale, which cooperatively allow the operator to continuously and incrementally adjust the rotational position of the adjustment screw for an optimal impact force setting;

an adapter below the adjustment screw and non-rotatably supported within the housing in a longitudinally slidable relation;

a nut non-rotatably received in an upper end of the adapter, the lower end of the adjustment screw being received by the nut which, together with the housing, holds the adjustment screw rotatably supported in a centered position within the housing;

an elongated main drive compression spring having its upper end rigidly supported in non-rotatable relation within the adapter and engaged by the nut, which thereby acts as a drive spring seat;

and a hammer block non-rotatably supported within the housing below the drive spring, the lower end of the drive spring engaging the hammer block;

the adjustment screw, the adapter, the nut, and the drive spring cooperating to apply a manually pre-adjusted level of force to the upper surface of the hammer block as a function of an incremental rotational position of adjustment of the knurled knob.

* * * * *